US006865887B2

(12) United States Patent
Yamamoto

(10) Patent No.: US 6,865,887 B2
(45) Date of Patent: Mar. 15, 2005

(54) STIRLING ENGINE

(75) Inventor: Yasushi Yamamoto, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 158 days.

(21) Appl. No.: 10/662,301

(22) Filed: Sep. 16, 2003

(65) Prior Publication Data

US 2004/0194461 A1 Oct. 7, 2004

(30) Foreign Application Priority Data

Sep. 18, 2002 (JP) ..... 2002-271532

(51) Int. Cl.[7] ..... F01B 29/10
(52) U.S. Cl. ..... 60/520; 60/517
(58) Field of Search ..... 60/517, 518, 520

(56) References Cited

U.S. PATENT DOCUMENTS 3,508,393 A * 4/1970 Kelly ..... 60/526
3,579,980 A 5/1971 Kelly
3,733,974 A * 5/1973 Schuman ..... 92/172
3,807,904 A * 4/1974 Schuman ..... 417/207
4,642,988 A * 2/1987 Benson ..... 60/641.14
5,987,886 A * 11/1999 Sekiya et al. ..... 60/523
6,205,792 B1 3/2001 Anderson
2002/0017098 A1 2/2002 Johansson

FOREIGN PATENT DOCUMENTS

FR 2 819 555 7/2002

* cited by examiner

*Primary Examiner*—Hoang Nguyen

(57) ABSTRACT

A Stirling engine comprising:

a displacer unit having displacer cylinders, displacers slidably arranged in the chambers of the displacer cylinders, expansion chambers and contraction chambers into which, and from which, the operation gas flows with the operation of the displacers; and a power piston unit having a power cylinder having an operation chamber communicated with either the expansion chamber or the contraction chamber of the displacer unit, and a power piston slidably arranged in the power cylinder;

wherein the displacer cylinders of the displacer unit are equipped with a heating wall surrounding a heat source and cooling walls forming a plurality of cylinder chambers surrounding the heating wall; and the displacers of the displacer unit are slidably arranged in the plurality of cylinder chambers in the directions to approach the heat source and to separate away from the heat source.

7 Claims, 11 Drawing Sheets

(a)

(b)

(a)

(b)

STIRLING ENGINE

FIELD OF THE INVENTION

The present invention relates to a Stirling engine. More specifically, the invention relates to a Stirling engine of the displacer type that operates at a predetermined operation speed.

DESCRIPTION OF THE RELATED ART

A Stirling engine of the displacer type usually comprises a displacer cylinder, a displacer slidably disposed in the displacer cylinder, an expansion chamber and a contraction chamber into which, and from which, an operation gas flows with the operation of the displacer, an operation chamber that communicates with either the expansion chamber or the contraction chamber, a power piston that operates in response to a change in the pressure of the operation gas in the operation chamber, and a displacer operation means that operates the displacer maintaining a predetermined phase difference from the power piston. In the displacer cylinder and the operation chamber is contained an operation gas having a small specific heat, such as hydrogen, helium or the like. In the Stirling engine described above, the power piston is so constituted as to operate in response to a change in the pressure in the operation chamber with the expansion and contraction as the operation gas is heated and cooled.

In the Stirling engine of the displacer type as described above, the expansion chamber side of the displacer cylinder is heated and the contraction chamber side is cooled. In general, a combustion chamber is provided on the expansion chamber side of the displacer cylinder as disclosed in, for example, JP-A 5-44576 and Japanese Patent 2600219. There has further been proposed the one of the type in which a heating chamber is provided to surround the displacer cylinder on the side of the expansion chamber and a heated fluid is introduced into the heating chamber.

According to the conventional Stirling engines, however, the displacer cylinder on the side of the expansion chamber is heated from the surrounding thereof, and the heat of the heat source has not necessarily been effectively utilized.

SUMMARY OF THE INVENTION

It is an object of the present invention to provide a Stirling engine which is capable of effectively utilizing the heat of the heat source.

In order to achieve the above object according to the present invention, there is provided a Stirling engine comprising:

- a displacer unit having displacer cylinders, displacers slidably arranged in the chambers of the displacer cylinders, expansion chambers and contraction chambers into which, and from which, an operation gas flows with the operation of the displacers; and
- a power piston unit having a power cylinder with an operation chamber that communicates with either the expansion chamber or the contraction chamber of the displacer unit, and a power piston slidably arranged in the power cylinder;
- wherein the displacer cylinders of the displacer unit are equipped with a heating wall surrounding a heat source and cooling walls forming a plurality of cylinder chambers surrounding the heating wall; and
- the displacers of the displacer unit are slidably arranged in the plurality of cylinder chambers in the directions to approach the heat source and to separate away from the heat source.

The heating wall of the displacer cylinders forms a flow passage through which the heat source flows, and the flow passage formed by the heating wall is of a cylindrical shape.

It is desired that a plurality of fins are provided in the axial direction on the inner peripheral surface of the cylindrical heating wall constituting the displacer cylinders, and that the fins are formed in a spiral shape. It is further desired that a core member is arranged in the central portion of the flow passage formed by the cylindrical heating wall constituting the displacer cylinders over nearly the full length of the flow passage.

According to the present invention, there is further provided a Stirling engine in which:

- the displacer unit comprises a pair of displacer cylinders arranged facing each other and a pair of displacers slidably arranged in the pair of displacer cylinders;
- the power piston unit comprises a power cylinder that communicates with either the expansion chambers or the contraction chambers of the pair of displacers, and a power piston that is slidably arranged in the power cylinder and divides it into a first operation chamber and a second operation chamber; and
- the first operation chamber of the power piston unit is communicated with either the expansion chamber or the contraction chamber of the displacer unit through a first communication passage, and the second operation chamber of the power piston unit is communicated with the other expansion chamber or the contraction chamber of the displacer unit through a second communication passage.

DETAILED DESCRIPTION OF THE PREFERRED EMBODIMENTS

Preferred embodiments of the Stirling engine constituted according to the present invention will now be described in further detail with reference to the accompanying drawings.

Figure 1:
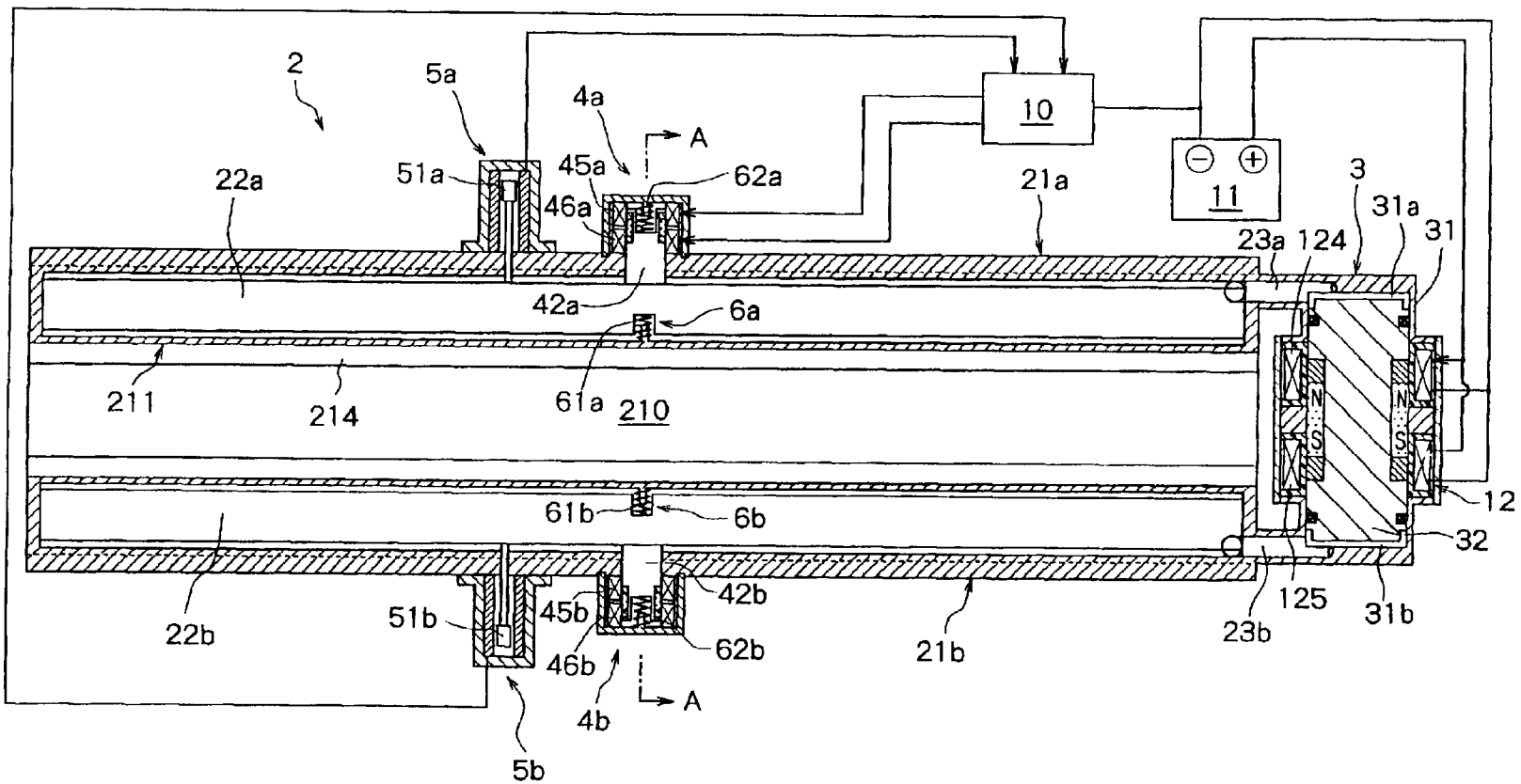
FIG. 1 is a sectional view illustrating one embodiment of a Stirling engine constituted according to the present invention.
Figure 2:
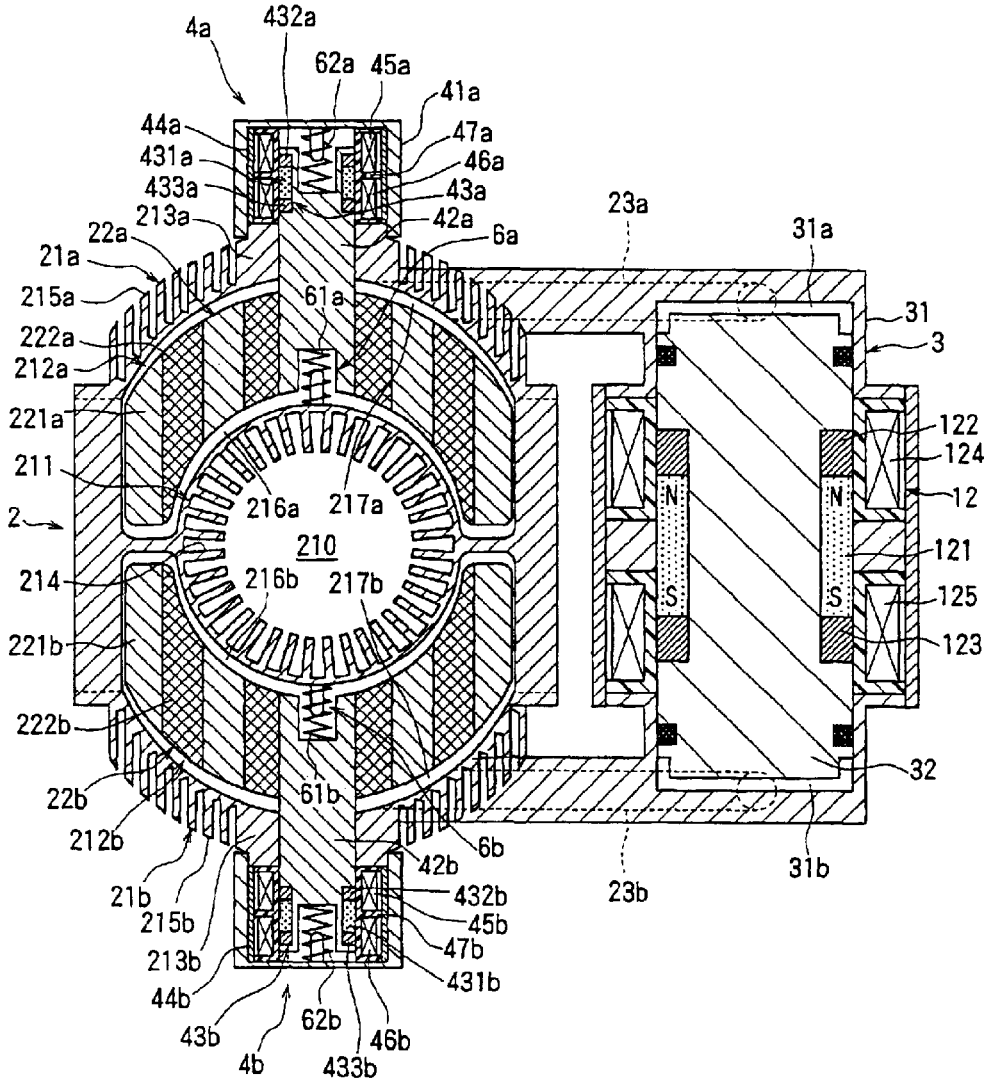
FIG. 2 is a sectional view along the line A—A in FIG. 1.

FIG. 1 is a vertical sectional view illustrating an embodiment of the Stirling engine constituted according to the present invention, and FIG. 2 is a sectional view along the line A—A in FIG. 1.

The Stirling engine of the embodiment shown in FIGS. 1 and 2 has a displacer unit 2 and a power piston unit 3. The displacer unit 2 in the illustrated embodiment comprises a pair of displacer cylinders 21*a* and 21*b* that is made of nonmagnetic material such as aluminium alloy or the like, and a pair of displacers 22*a* and 22*b* each slidably disposed in the pair of displacer cylinders 21*a* and 21*b*. The pair of displacer cylinders 21*a* and 21*b* are constituted by a cylindrical heating wall 211 forming a flow passage 210 through which a heat source flows, and a pair of cooling walls 213*a* and 213*b* forming a pair of cylinder chambers 212*a* and 212*b* together with the heating wall 211. A plurality of fins 214 are radially formed in the axial direction on the inner peripheral surface of the cylindrical heating wall 211. The pair of cooling walls 213*a* and 213*b* form upper and lower cylinder chambers 212*a* and 212*b* so as to each surround nearly the half outer circumference of the cylindrical heating wall 211, and have a plurality of heat-radiating fins 215*a*, 215*b* formed on the outer peripheral surfaces thereof in the axial direction. To one end of the cylindrical heating wall 211 constituting the thus constituted pair of displacer cylinders 21*a* and 21*b* is connected, for example, an exhaust pipe of an internal combustion engine. Therefore, the exhaust gas of an internal combustion engine flows as a heat source through the flow passage 210 formed by the cylindrical heating wall 211. As described above, the heating wall 211 is formed surrounding the heat source.

The pair of displacers 22*a* and 22*b* arranged in the cylinder chambers 212*a* and 212*b* of the pair of displacer cylinders 21*a* and 21*b* have inner peripheral surfaces that are formed as arcuate surfaces which corresponds to the outer peripheral surface of the heating wall 211 that constitutes the displacer cylinders 21*a* and 21*b*, and further have outer peripheral surfaces formed as arcuate surfaces which corresponds to the inner peripheral surfaces of the cooling walls 213*a* and 213*b* constituting the displacer cylinders 21*a* and 21*b*. Further, the pair of displacers 22*a* and 22*b* have a plurality of holding plates 221*a* and 221*b* extending in the axial direction and regenerators 222*a* and 222*b* arranged between the plurality of holding plates 221*a* and 221*b*. The regenerators 222*a* and 222*b* are constituted by alternately overlapping the heat-insulating rings and metal gauzes. The thus constituted pair of displacers 22*a* and 22*b* are each disposed in the cylinder chambers 212*a* and 212*b* of the pair of displacer cylinders 21*a* and 21*b* so as to slide in the directions at right angles with the axial direction of the cylindrical heating wall 211, i.e., in the directions to approach and separate away from the heat source. An expansion chamber 216*a*, a contraction chamber 217*a*, an expansion chamber 216*b* and a contraction 217*b* are formed in the cylinder chambers 212*a* and 212*b* of the pair of displacer cylinders 21*a* and 21*b* in which the pair of displacers 22*a* and 22*b* are slidably disposed.

The power piston unit 3 is constituted by a power cylinder 31 made of a nonmagnetic material such as an aluminum alloy or the like and a power piston 32 that is made of a nonmagnetic material and is slidably disposed in the power cylinder 31. The power cylinder 31 in which the power piston 32 is arranged has a first operation chamber 31*a* and a second operation chamber 31*b* formed on both sides of the power piston 32. The first operation chamber 31*a* and the second operation chamber 31*b* are each communicated with the contraction chamber 217*a* of one displacer cylinder 21*a* and with the contraction chamber 217*b* of the other displacer cylinder 21*b* through a first communication passage 23*a* and a second communication passage 23*b*.

As described above, the pair of displacer cylinders 21*a*, 21*b*, power cylinder 31, first communication passage 23*a* and second communication passage 23*b* form a closed space. The thus closed pair of displacer cylinders 21*a* and 21*b*, first operation chamber 31*a* and second operation chamber 31*b* of the power cylinder 31, first communication passage 23*a* and second communication passage 23*b* are filled with an operation gas having a small specific heat, such as hydrogen or helium.

The Stirling engine of the illustrated embodiment has a pair of displacer operation means 4*a* and 4*b* for operating each of the pair of displacers 22*a* and 22*b* maintaining a predetermined phase difference (180 degrees) from the power piston 32. The pair of displacer operation means 4*a* and 4*b* are respectively disposed at the central portions of the pair of displacer cylinders 21*a*, 21*b* and of the displacers 22*a*, 22*b* in the circumferential direction and in the lengthwise direction (axial direction). The pair of displacer operation means 4*a* and 4*b* comprise casings 41*a* and 41*b* made of a nonmagnetic material mounted on the central portions of the cooling walls 213*a* and 213*b* of the pair of displacer cylinders 21*a* and 21*b* in the circumferential direction and in the lengthwise direction (axial direction), operation rods 42*a* and 42*b* that are made of a nonmagnetic material, coupled to the pair of displacers 22*a*, 22*b* and inserted in the casings 41*a* and 41*b* penetrating through the cooling walls 213*a* and 213*b*, moving magnets 43*a* and 43*b* disposed on the outer peripheral surfaces of the operation rods 42*a* and 42*b*, cylindrical fixed yokes 44*a* and 44*b* disposed on the inside of the casing 41*a* and 41*b* surrounding the moving magnets 43*a* and 43*b*, and pairs of coils 45*a*, 46*a* and 45*b*, 46*b* juxtaposed on the inside of the fixed yokes 44*a* and 44*b* in the axial directions.

The moving magnets 43*a* and 43*b* are constituted by annular permanent magnets 431*a* and 431*b* that are mounted on the outer peripheral surfaces of the operation rods 42*a* and 42*b* and have magnetic poles at both end surfaces in the axial direction, and pairs of moving yokes 432*a*, 433*a* and 432*b*, 433*b* arranged on the outside of the permanent magnets 431*a* and 431*b* in the axial direction. In the illustrated embodiment, the permanent magnets 431*a* and 431*b* have their upper end surfaces magnetized into N-pole and have their lower end surfaces magnetized into S-pole. The pairs of moving yokes 432*a*, 433*a* and 432*b*, 433*b* are made of a magnetic material in an annular shape.

The fixed yokes 44*a* and 44*b* are made of a magnetic material in a cylindrical shape. Pairs of coils 45*a*, 46*a* and 45*b*, 46*b* are respectively arranged on the inside of the fixed yokes 44*a* and 44*b*. The pairs of coils 45*a*, 46*a* and 45*b*, 46*b* are respectively wound on the bobbins 47*a* and 47*b*, in the opposite directions with each other, that are respectively made of the nonmagnetic material such as a synthetic resin or the like and mounted along the inner peripheries of the fixed yokes 44*a* and 44*b*. The directions of currents supplied to the pair of coils 45*a*, 46*a* and 45*b*, 46*b* can be controlled to be changed over by a control means 10 that will be described later.

As described above, the displacer operation means 4*a* and 4*b* are constituted by the moving magnets 43*a* and 43*b*, fixed yokes 44*a* and 44*b* and pairs of coils 45*a*, 46*a* and 45*b*, 45*b*, and operate based on the principle of a linear motor. The operation will be described below with reference to FIGS. 3 and 4.

Figure 3:
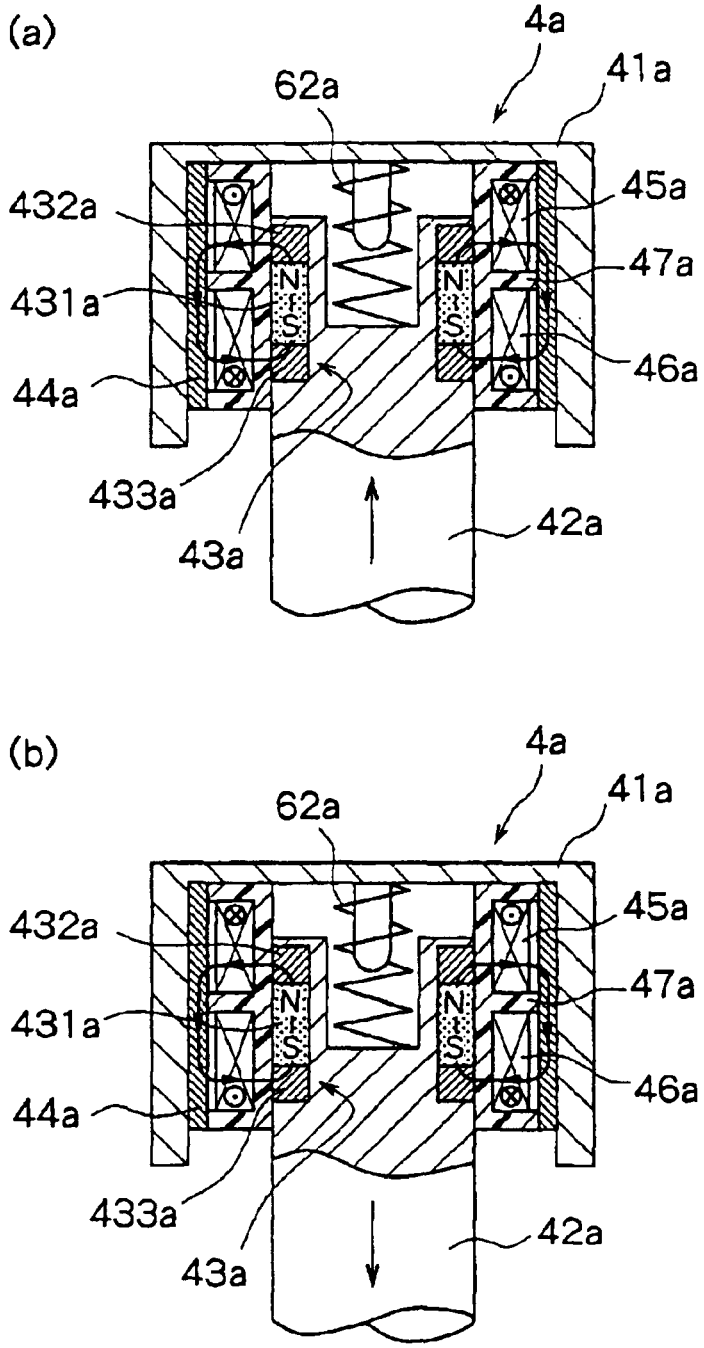
FIG. 3 is a view illustrating the operation of one displacer operation means constituting the Stirling engine according to the present invention.
Figure 4:
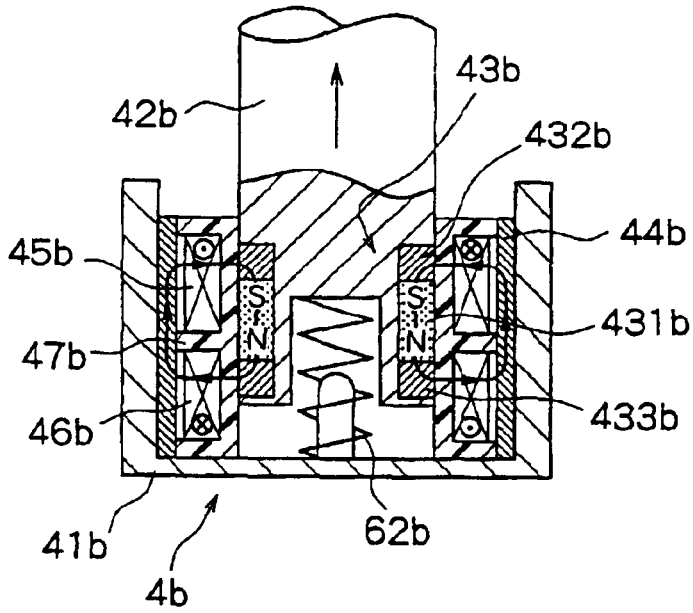
FIG. 4 is a view illustrating the operation of the other displacer operation means constituting the Stirling engine according to the present invention.
Figure 4:
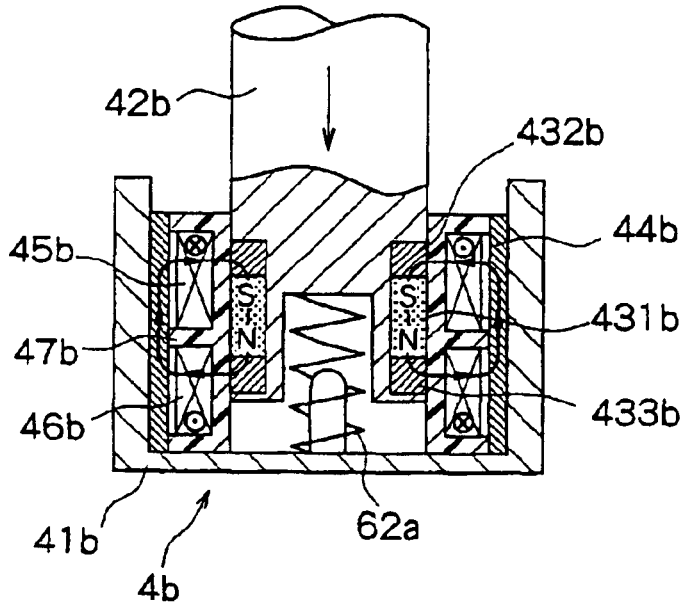

In the displacer operation means 4*a* and 4*b* of the illustrated embodiment, there are formed magnetic circuits as shown in FIGS. 3(*a*), 3(*b*) and in FIGS. 4(*a*), (4*b*) passing through the N-poles of permanent magnets 431*a* and 431*b*, moving yokes 432*a* and 432*b* on one side, coils 45*a* and 45*b* on one side, fixed yokes 44*a* and 44*b*, other coils 46*a* and 46*b*, moving yokes 433*a* and 433*b* of the other side, and S-poles of permanent magnets 431*a* and 431*b*. In this state, when electric currents are supplied to the pairs of coils 45*a*, 46*a* and 45*b*, 46*b* in the directions as shown in FIGS. 3(*a*) and 4(*a*), an upward thrust generates in the moving magnets 43*a* and 43*b*, i.e., in the displacers 22*a* and 22*b* according to Fleming's left-hand rule as indicated by arrows in FIGS. 3(*a*) and 4(*a*). On the other hand, when electric currents are supplied to the pairs of coils 45*a*, 46*a* and 45*b*, 46*b* in the directions as shown in FIGS. 3(*b*) and 4(*b*) which are opposite to those of FIGS. 3(*a*) and 4(*a*), a downward thrust generates in the moving magnets 43*a* and 43*b*, i.e., in the displacers 22*a* and 22*b* according to Fleming's left-hand rule as indicated by arrows in FIGS. 3(*b*) and 4(*b*).

Figure 5:
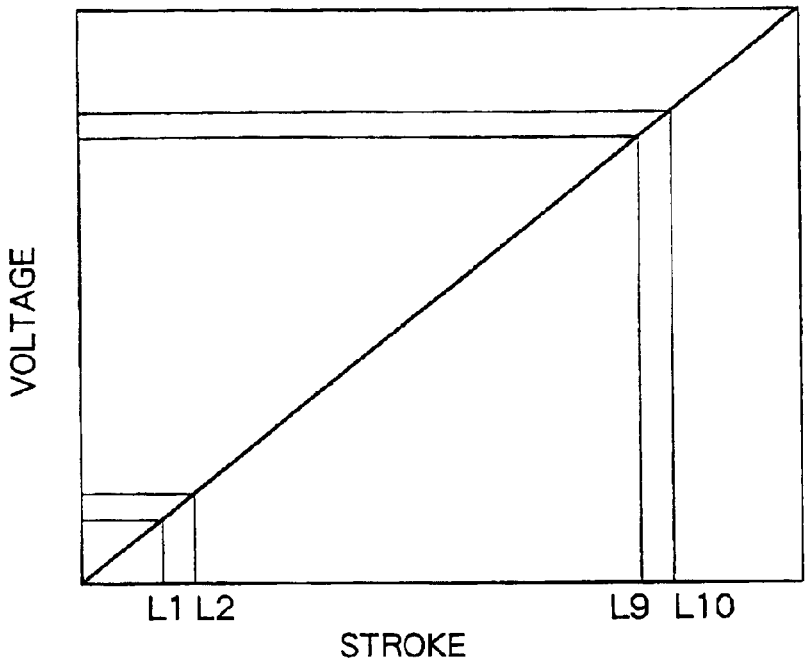
FIG. 5 is a diagram illustrating output signals of a displacer position detection means constituting the Stirling engine according to the present invention.

The Stirling engine of the illustrated embodiment is provided with displacer position detection means 5*a* and 5*b* for detecting the operation positions of the above pair of displacers 22*a* and 22*b*. The displacer position detection means 5*a* and 5*b* are each constituted by stroke sensors for detecting the moving positions of the operators 51*a* and 51*b* coupled at the ends on one side thereof to the displacers 22*a* and 22*b* at the central portions in the circumferential direction, and sends the detection signals to the control means 10 that will be described later. Output values of the stroke sensors that are the displacer position detection means 5*a*, 5*b* will now be described with reference to FIG. 5. In FIG. 5, the abscissa shows the strokes of the displacers 22*a*, 22*b*, i.e., the operators 51*a*, 51*b*, and the ordinate shows the voltage. As shown in FIG. 5, the stroke sensors produce voltages that are in proportion to the strokes of the displacers 22*a*, 22*b*, i.e., the operators 51*a*, 51*b*. In FIG. 5, L1 on the abscissa is a full-stroke position on the return side and L10 is a full-stroke position on the feed side.

The Stirling engine of the illustrated embodiment is provided with mechanical spring means 6*a*, 6*b* for imparting a predetermined oscillation cycle to the pair of displacers 22*a* and 22*b*. The mechanical spring means 6*a*, 6*b* comprise each pairs of coil springs 61*a*, 62*a* and 61*b*, 62*b* disposed between the inner peripheral surfaces of the displacers 22*a*, 22*b* and the heating wall 211 of the displacer cylinders 21*a*, 21*b*, and between the operation rods 42*a*, 42*b* coupled to the displacer cylinders 21*a*, 21*b* and the casings 41*a*, 41*b*. The pairs of springs 61*a*, 62*a* and 61*b*, 62*b* urge each other the displacers 22*a* and 22*b* toward the neutral positions thereof. The oscillation cycle is determined by the pairs of coil springs 61*a*, 62*a*, 61*b* and 62*b* and by the masses of the displacers 22*a* and 22*b*. By operating the displacers 22*a* and 22*b* at a predetermined cycle determined by the pairs of coil springs 61*a*, 62*a* and 61*b*, 62*b* and by the masses of the displacers 22*a* and 22*b*, the driving force of the displacer operation means 4*a* and 4*b* may be enough to be very small. That is, when the displacer 5 is operated by the displacer operation means 4*a* and 4*b* at the above predetermined cycle, the amplitudes of the pairs of coil springs 61*a*, 62*a* and 61*b*, 62*b* gradually increase, i.e., the moving widths of the displacers 22*a* and 22*b* gradually increase and reach a predetermined value due to simple harmonic motion, and establish a steady state operation. Thereafter, the displacers 22*a* and 22*b* are operated at a predetermined cycle due to the action of the pairs of coil springs 61*a*, 62*a* and 61*b*, 62*b*, but attenuate due to the air resistance. Therefore, the attenuation may be compensated by the driving force produced by the displacer operation means 4*a* and 4*b*.

The control means 10 is constituted by a microcomputer that is connected to a battery 11, and comprises a central processing unit (CPU) for executing the processing according to a control program and the like, a read-only memory (ROM) for storing the control program, a random access memory (RAM) for storing results of the operation, and a drive circuit for driving the pairs of coils 45*a*, 46*a* and 45*b*, 46*b* of the displacer operation means 4*a* and 4*b*. Based on the operation position signals of the displacers 22*a* and 22*b* detected by the displacer position detection means 5*a* and 5*b*, the control means 10 controls drive currents to the pairs of coils 45*a*, 46*a* and 45*b*, 46*b* constituting the displacer operation means 4*a* and 4*b*.

An electric generator 12 is disposed for the power piston 32 and for the power cylinder 31 constituting the power piston unit 3. In the illustrated embodiment, the generator 12 is a linear generator constituted by an annular permanent magnet 121 arranged on the outer peripheral surface of the power piston 32, annular magnetic pole pieces 122 and 123 arranged on both sides of the permanent magnet 121, and generating coils 124 and 125 disposed on the outer peripheral surface of the power cylinder 31 surrounding the permanent magnet 121. The thus constituted generator 12 generates electricity by a left-and-right motion of the power piston 33, i.e., permanent magnet 121 in FIG. 1, and the generated electric power is stored in the battery 11.

Figure 6:
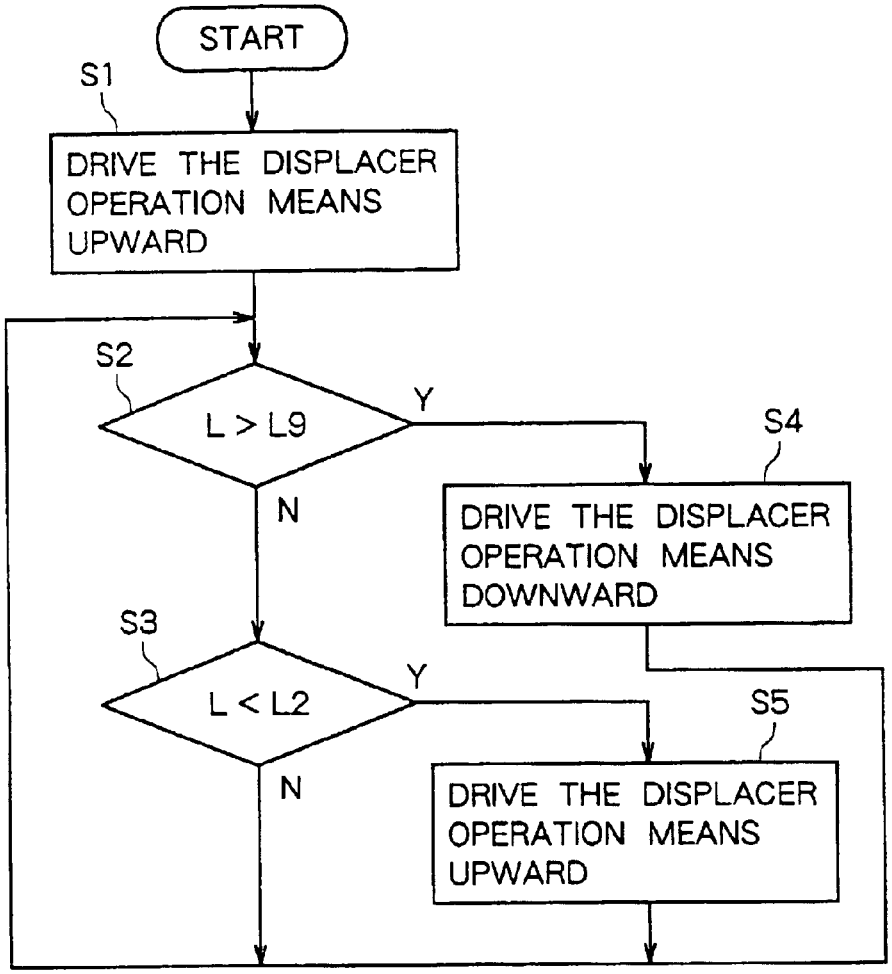
FIG. 6 is a flowchart illustrating the procedure of operation of a control means constituting the Stirling engine according to the present invention.

The Stirling engine of the embodiment shown in FIGS. 1 and 2 is constituted as described above. The operation will now be described with reference to a flowchart of FIG. 6 and a view illustrating the operation states thereof in FIG. 7.

Figure 7:
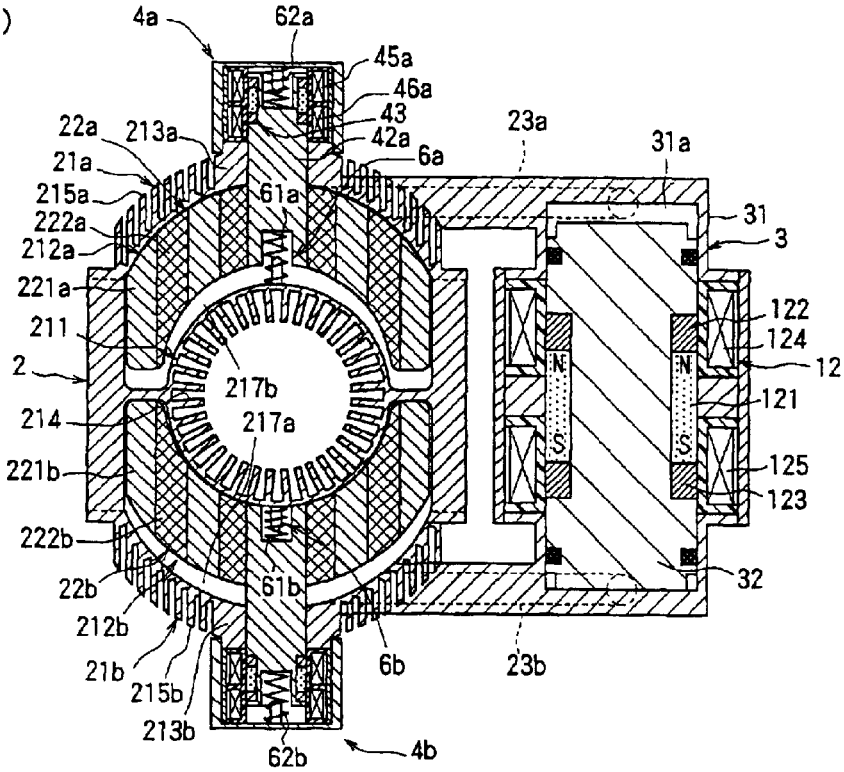
FIG. 7 is a view illustrating the operation states of the Stirling engine shown in FIG. 1.
Figure 7:
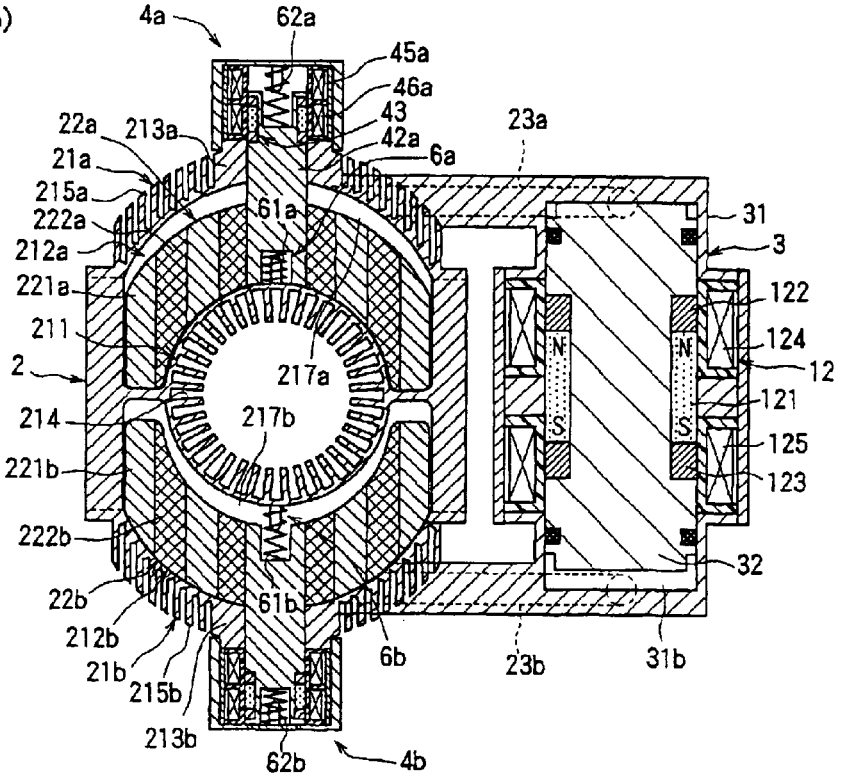

FIGS. 1 and 2 illustrate a state of before the operation, where the displacers 22*a* and 22*b* are respectively brought to their neutral positions due to the action of the pairs of coil springs 61, 62*a* and 61*b*, 62*b*. To start the Stirling engine in the state shown in FIGS. 1 and 2, the control means 10 causes the displacer operation means 4*a* and 4*b* to drive so that the displaces 22*a* and 22*b* move upward in the drawing (step S1). That is, the control means 10 controls to supply electric currents to the pairs of coils 45*a*, 46*a* and 45*b*, 46*b* constituting the displacer operation means 4*a* and 4*b* in the directions shown in FIGS. 3(*a*) and 4(*a*). As a result, the moving magnets 43*a* and 43*b* or the displacers 22*a* and 22*b* move upward as shown in FIG. 7(*a*). Due to the upward motion of the displacers 22*a* and 22*b*, the operation gas in the contraction chamber 217*a* of one displacer cylinder 21*a* flows into the expansion chamber 216*a* through the regenerator 222*a* of the displacer 22*a*, and the operation gas in the expansion chamber 216*b* of the other displacer cylinder 21*b* flows into the contraction chamber 217*b* through the regenerator 222*b* of the displacer 22*b*. On this occasion, the operation gas that had been cooled in the contraction chamber 217*a* of the one displacer cylinder 21*a* is heated by heat exchange as it passes through the regenerator 222*a*. On the other hand, the operation gas that had been heated in the expansion chamber 216*b* of the other displacer cylinder 21*b* is cooled by heat exchange as it passes through the regenerator 222*b*, as described above. Thus, as the one displacer 22*a* moves upward and the operation gas flows into the expansion chamber 216*a*, the operation gas expands being heated by the exhaust gas as the heat source that flows through the flow passage 210 formed by the cylindrical heating wall 211. Therefore, the operation gas flows into the first operation chamber 31*a* of the power cylinder 31 through the first communication passage 23*a*. As a result, the power piston 32 moves downward as shown in FIG. 7(*a*). On the other hand, as the other displacer 22*b* moves upward and the operation gas flows into the contraction chamber 217*b*, the operation gas contracts being cooled by the air or by a suitable cooling means. Therefore, the operation gas in the second operation chamber 31*b* of the power cylinder 31 is sucked through the second communication passage 23*b*. As a result, the power piston 32 is caused to move downward as shown in FIG. 7(*a*).

At step S1 as described above, the displacer operation means 4*a* and 4*b* are so driven as to move the pair of displacers 22*a* and 22*b* upward in the drawing. Then, the routine proceeds to step S2 where the control means 10 checks, based on the detection signals from the displacer position detection means 5*a* and 5*b*, whether the stroke position L of the displacers 22*a* and 22*b* is larger than a stroke position L9 that is a threshold value smaller, by a predetermined amount, than the full-stroke position L10 on the feed side (L>L9). When the stroke position L is not larger than L9, the routine proceeds to step S3 where the control means 10 checks whether the stroke position L of the displacers 22*a* and 22*b* is smaller than a stroke position L2 that is a threshold value larger, by a predetermined amount, than the full-stroke position L1 on the return side (L<L2). This time, the displacers 22*a* and 22*b* are moved toward the feed side and hence, it does not happen that the stroke position L becomes smaller than L2. Accordingly, the control means 10 returns to step S2.

When the stroke position L is larger than L9 at step S2, the control means 10 judges that the displacers 22*a* and 22*b* have exceeded the position that is smaller, by a predetermined amount, than a position at the time of the end of expansion, shown in FIG. 7(*a*), and the routine proceeds to step S4 to drive the displacer operation means 4*a* and 4*b* so as to move the displacers 22*a* and 22*b* downward in the drawing. That is, the control means 10 controls to supply electric currents to the pairs of coils 45*a*, 46*a* and 45*b*, 46*b* constituting the displacer operation means 4*a* and 4*b* in the directions shown in FIGS. 3(*b*) and 4(*b*). As a result, the moving magnets 43, i.e., the displacers 22*a* and 22*b* move downward as shown in FIG. 7(*b*). Due to the downward motion of the displacers 22*a* and 22*b*, the operation gas in the expansion chamber 216*a* of one displacer cylinder 21*a* flows into the contraction chamber 217*a* through the regenerator 222*a* of the displacer 22*a*, while the operation gas in the contraction chamber 217*b* of the other displacer cylinder 21*b* flows into the expansion chamber 216*b* through the regenerator 222*b* of the displacer 22*b*. On this occasion, the operation gas that had been heated in the expansion chamber 216*a* of one displacer cylinder 21*a* is cooled by heat exchange as it passes through the regenerator 222*a* as described above. Further, the operation gas that had been cooled in the contraction chamber 217*b* of the other displacer cylinder 21*b* is heated by heat exchange as it passes through the regenerator 222*b* as described above. Thus, as the one displacer 22*a* moves downward and the operation gas flows into the contraction chamber 217*a*, the operation gas contracts being cooled by the by the air or by a suitable cooling means. Therefore, the operation gas in the first operation chamber 31*a* of the power cylinder 31 is sucked through the first communication passage 23*a*. As a result, the power piston 32 moves upward as shown in FIG. 7(*b*). On the other hand, as the other displacer 22*b* moves downward and the operation gas flows into the expansion chamber 216*b*, the operation gas expands being heated by the exhaust gas as the heat source that flows through the flow passage 210 formed by the cylindrical heating wall 211. Therefore, the operation gas flows into the second operation chamber 31*b* of the power cylinder 31 through the second communication passage 23*b*. As a result, the power piston 32 is caused to move upward as shown in FIG. 7(*b*).

At step S4 as described above, the displacer operation means 4*a* and 4*b* are driven so as to move the pair of displacers 22*a* and 22*b* downward in the drawing. Then, the routine returns back to the above step S2 where the control means 10 checks whether the stroke position L of the displacers 22*a* and 22*b* is larger than the stroke position L9 that is the threshold value smaller, by a predetermined amount, than the full-stroke position L10 on the feed side. This time, the displacers 22*a* and 22*b* are moved toward the return side and hence, it does not happen that the stroke position L becomes larger than L9. Therefore, the routine proceeds to step S3 where the control means 10 checks whether the stroke position L of the displacers 22*a* and 22*b* is smaller than the stroke position L2 that is the threshold value larger, by a predetermined amount, than the full-stroke position L1 on the return side. When the stroke position L is not smaller than L2, the control means 10 so judges that the displacers 22*a* and 22*b* have not yet reached L2, and the routine returns to the step S2 to repeat the steps S2 and S3. When the stroke position L of the displacers 22*a* and 22*b* is smaller than L2 at step S3, the control means 10 judges that the displacers 22*a* and 22*b* have exceeded L2, and the routine proceeds to step S5 where the control means 10 controls to supply electric currents to the pairs of coils 45*a*, 46*a* and 45*b*, 46*b* in the directions shown in FIGS. 3(*a*) and 4(*a*) to drive the displacer operation means 4*a* and 4*b* so that the displacers 22*a* and 22*b* operate upwards in the drawing.

By repeating the above cycle, the power piston 32 can do reciprocating motion. As the power piston 32 performs reciprocating motion, the generator 12 generates electricity which is then stored in the battery 12. In the Stirling engine of the illustrated embodiment, the pair of displacer cylinders 21*a* and 21*b* of the displacer unit 2 are constituted by the cylindrical heating wall 211 having the flow passage 210 through which the heat source flows and the cooling walls 213*a* and 213*b* forming the pair of cylinder chambers 212*a* and 212*b* surrounding the heating wall 211. Therefore, the heat of the heat source flowing through the flow passage 210 is effectively utilized without being emanated to the surrounding. Further, the heating wall 211 is formed in an arcuate shape and can have a wide heat-receiving area to effectively absorb the heat of the heat source. Even when the exhaust gas of an internal combustion engine flows through the flow passage 210, further, pressure loss of the exhaust gas does not almost occur and hence, performance of the internal combustion engine is not affected. In the Stirling engine of the illustrated embodiment, further, since a closed space is formed by the pair of displacer cylinders 21*a* and 21*b*, power cylinder 31, first passage 23*a* and second passage 23*b*, the leakage of the operation fluid can be reliably prevented. In the Stirling engine of the illustrated embodiment, further, the pair of displacers 22*a* and 22*b* are operated by the action of the pairs of coil springs 61*a*, 62*a* and 61*b*, 62*b* at a predetermined cycle. Therefore, the displacer operation means 4*a* and 4*b* for operating the displacers 22*a* and 22*b* at a predetermined cycle can be worked enough by a driving force for compensating the attenuation caused by the air resistance and the like; i.e., the driving force for operating the displacer operation means 4*a* and 4*b* can be decreased.

Figure 8:
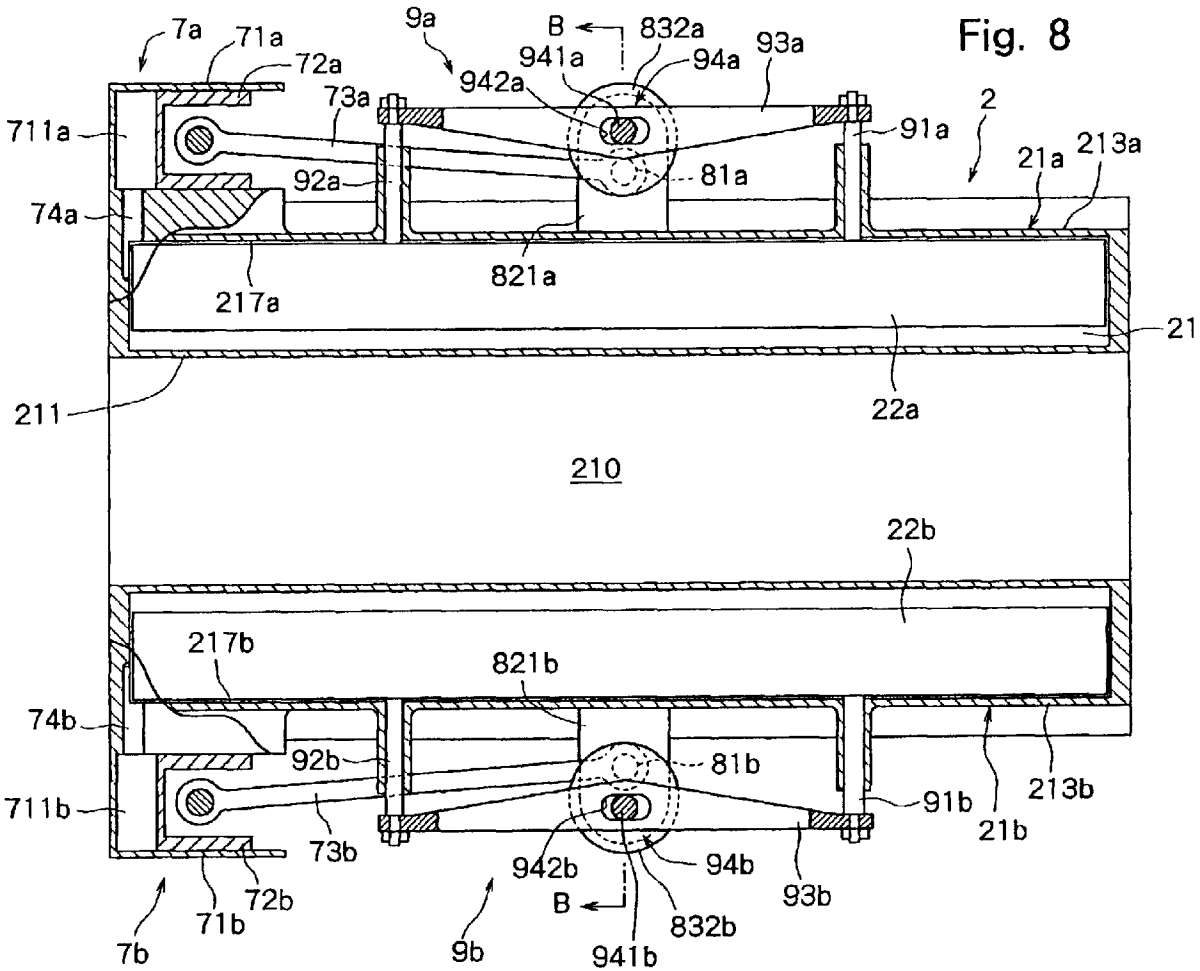
FIG. 8 is a sectional view illustrating another embodiment of the Stirling engine constituted according to the present invention.
Figure 9:
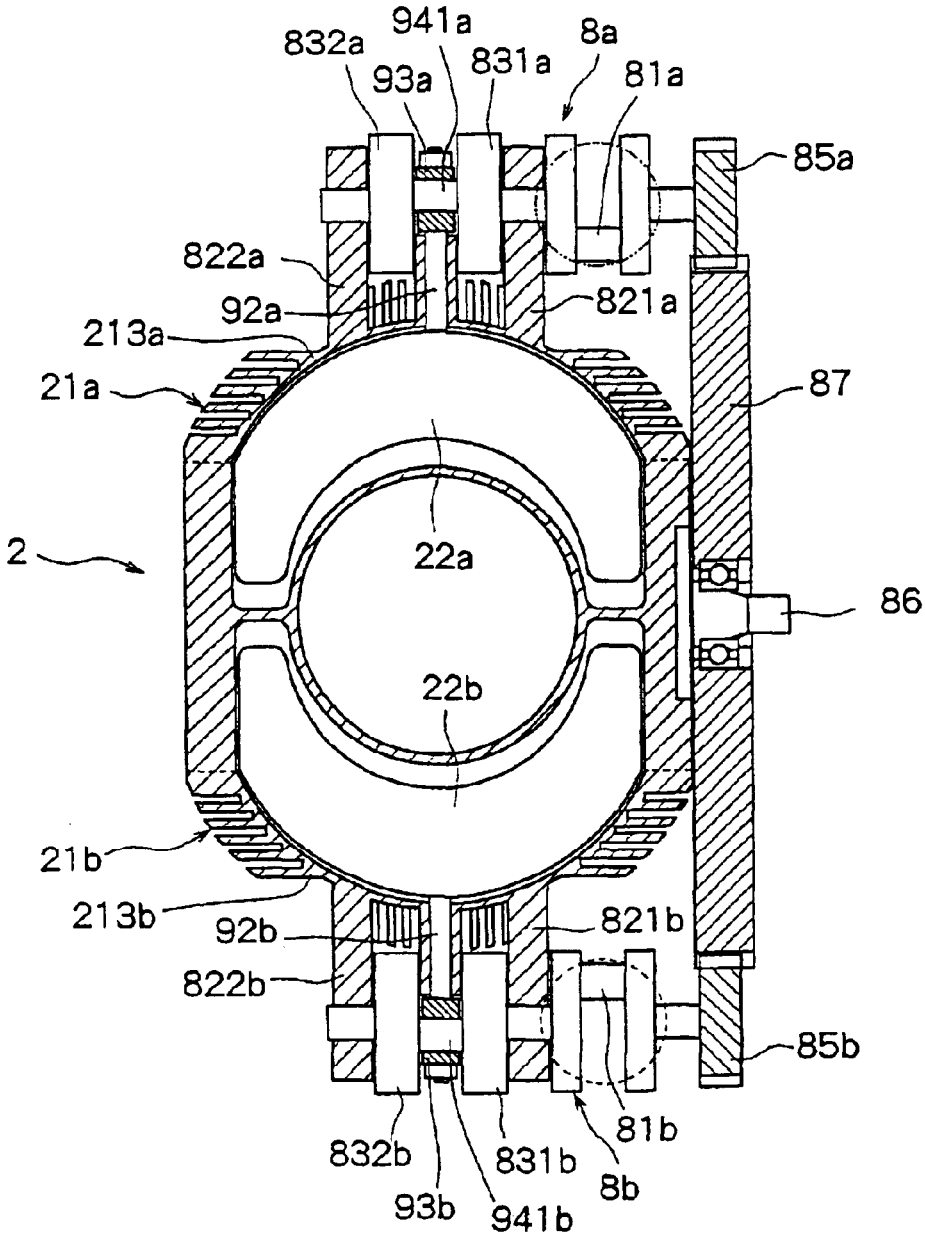
FIG. 9 is a sectional view along the line B—B in FIG. 8.

Next, another embodiment of the Stirling engine constituted according to the present invention will be described with reference to FIGS. 8 and 9. In the embodiment of FIGS. 8 and 9, the same members as those constituting the Stirling engine shown in FIGS. 1 and 2 are denoted by the same reference numerals but their description is not repeated.

The Stirling engine illustrated in FIGS. 8 and 9 are so constituted as to rotate a crankshaft. In the embodiment illustrated in FIGS. 8 and 9, a pair of power piston units 7*a* and 7*b* corresponding to the pair of displacer cylinders 21*a* and 21*b* that constitute the displacer unit 2 in the above-described embodiment of the present invention, are provided. The power piston units 7*a* and 7*b* comprise power cylinders 71*a* and 71*b*, power pistons 72*a* and 72*b* slidably arranged in the power cylinders 71*a* and 71*b*, and connecting rods 73*a* and 73*b* connected at the ends on one side thereof to the power pistons 72*a* and 72*b*.

The power cylinders 71*a* and 71*b* are mounted on the cooling walls 213*a* and 213*b* constituting the displacer cylinders 21*a* and 21*b* along the lengthwise direction (axial direction) of the cooling walls 213*a* and 213*b* of the displacer cylinders 21*a* and 21*b*. Operation chambers 711*a* and 711*b* are respectively formed in the power cylinders 71*a* and 71*b* together with the power pistons 72*a* and 72*b* arranged therein so as to slide in the axial direction. The operation chambers 711*a* and 711*b* are communicated, through the communication passages 74*a* and 74*b*, with the contraction chambers 217*a* and 217*b* in the pair of displacer cylinders 21*a* and 21*b* constituting the displacer unit 2. The connecting rods 73*a* and 73*b* connected at the ends on one side thereof to the power pistons 72*a* and 72*b* are connected at the ends on the other side thereof to crank journals 81*a* and 81*b* of crankshafts 8*a* and 8*b*. The crankshafts 8*a* and 8*b* are rotatably supported by the cooling walls 213*a* and 213*b* constituting the displacer cylinders 21*a* and 21*b* through respective support brackets 821*a*, 822*a* and 821*b*, 822*b*. Small gears 85*a* and 85*b* are mounted on the ends of the crankshafts 8*a* and 8*b* on one side thereof. The small gears 85*a* and 85*b* are in mesh with a large gear 87 which also serves as a fly-wheel and is rotatably supported, through a support shaft 86, by the cooling walls 213*a* and 213*b* constituting the displacer cylinders 21*a* and 21*b*. The large gear 87 that also serves as the fly-wheel and the crankshafts 8*a* and 8*b* that are coupled together through small gears 85*a* and 85*b* are so constituted that they are operated maintaining a phase difference of 180 degrees relative to each other.

The Stirling engine of the illustrated embodiment has a pair of displacer operation means 9*a* and 9*b* for operating the pair of displacers 22*a* and 22*b* maintaining a predetermined phase difference (90 degrees) relative to the power pistons 72*a* and 72*b*. The pair of displacer operation means 9*a* and 9*b* are constituted by connecting rods 91*a*, 92*a* and 91*b*, 92*b* mounted at the ends on one side thereof on the displacers 22*a* and 22*b*, levers 93*a* and 93*b* to which are connected the connecting rods 91*a*, 92*a* and 91*b*, 92*b* at the ends on the other side thereof, and coupling mechanisms 94*a* and 94*b* for coupling the levers 93*a* and 93*b* to the crankshafts 8*a* and 8*b*. The coupling mechanisms 94*a* and 94*b* are constituted by pins 941*a* and 941*b* fitted between flange portions 831*a* and 832*a* and between flange portions 831*b* and 832*b* that are provided on the crankshafts 8*a* and 8*b*, and elongated holes 942*a* and 942*b* formed in the central portions of the levers 93*a* and 93*b*, the elongated holes 942*a* and 942*b* being formed elongated in the axial direction of the power cylinders 71*a* and 71*b*. In the thus constituted displacer operation means 9*a* and 9*b*, the crankshafts 8*a* and 8*b* rotate via the connecting rods 73 and 73*b* by a left-and-right reciprocating movement of the power pistons 72*a* and 72*b* in FIG. 8. At this time, since the levers 93*a* and 93*b* move up and down in FIG. 8 by the coupling mechanisms 94*a* and 94*b*, the displacers 22*a* and 22*b* are caused to move up and down in FIG. 8 via the connecting rods 91*a*, 92*a* and 91*b*, 92*b*. The action of the operation fluid caused by the up-and-down motion of the displacers 22*a* and 22*b* works in the same manner as in the embodiment described above.

Figure 10:
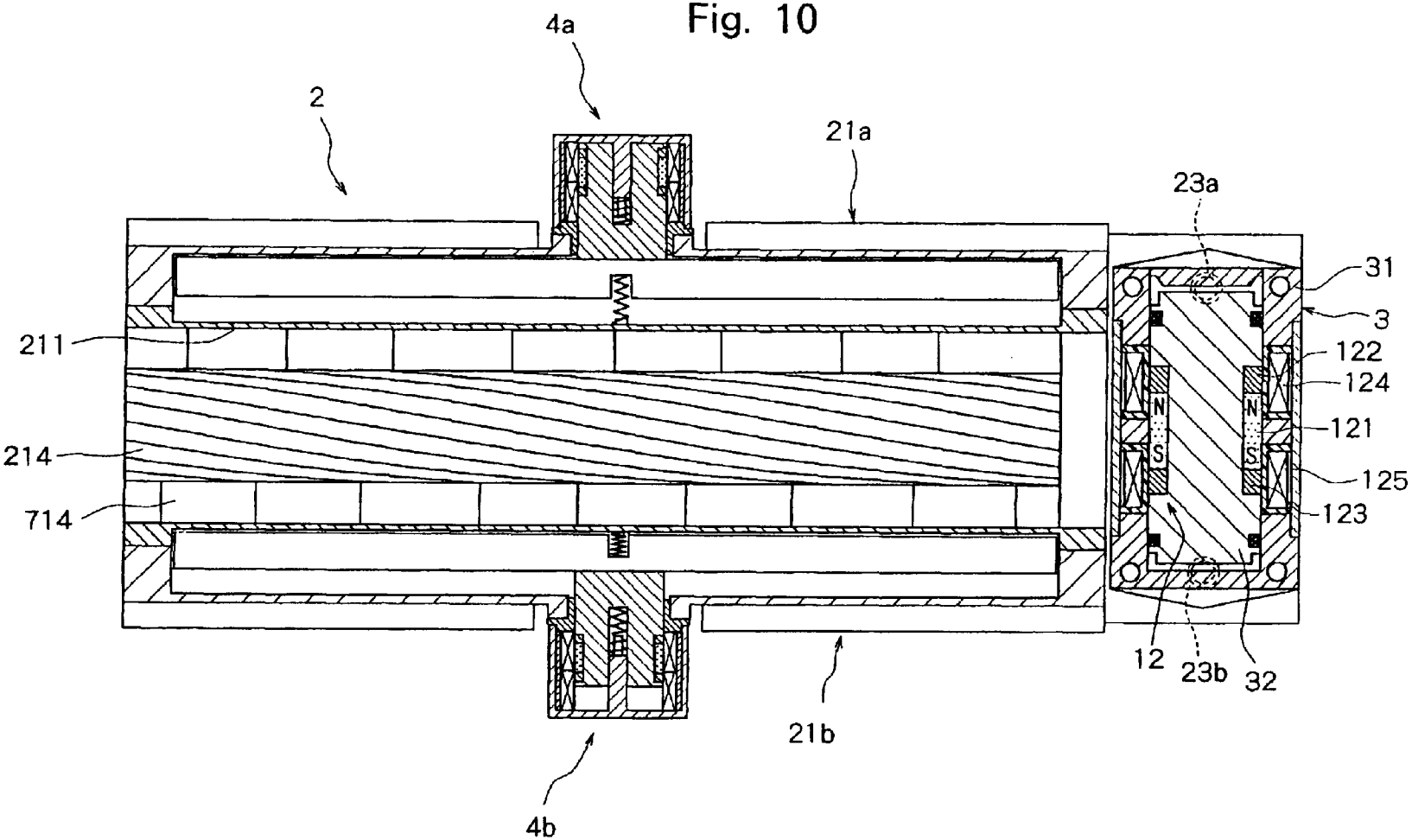
FIG. 10 is a sectional view illustrating essential portions of a further embodiment of the Stirling engine constituted according to the present invention.
Figure 11:
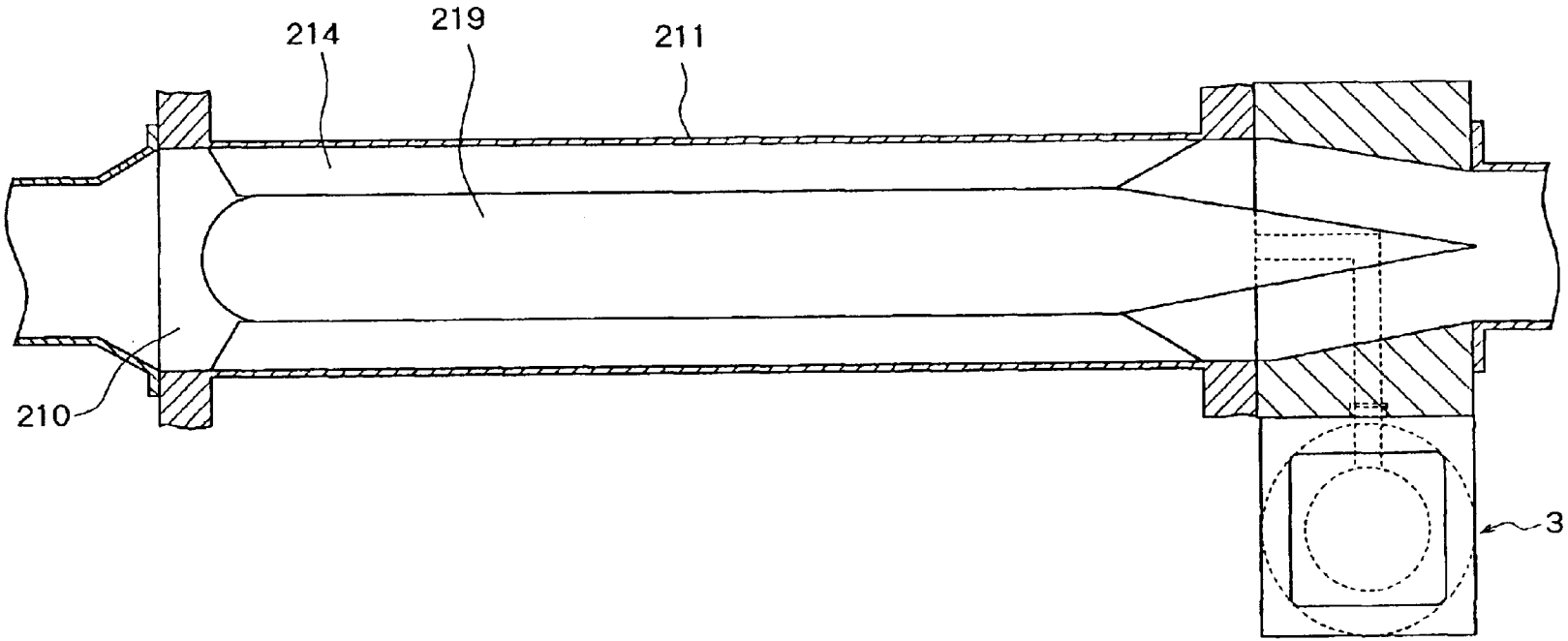
FIG. 11 is a sectional view illustrating essential portions of a still further embodiment of the Stirling engine constituted according to the present invention.

Next, further other embodiments of the Stirling engine constituted according to the present invention will be described with reference to FIGS. 10 and 11. In the embodiments of FIGS. 10 and 11, the same members as those constituting the Stirling engine shown in FIGS. 1 and 2 are denoted by the same reference numerals but their description is not repeated.

In the embodiment shown in FIG. 10, a plurality of fins 214 are formed in a spiral shape on the inner peripheral surface of a cylindrical heating wall 211 that constitutes a pair of displacer cylinders 21*a* and 21*b* of the displacer unit 2. By thus forming the fins 214 in a spiral shape, a flow passage of the fins on which the exhaust gas as the heat source flows through the flow passage 210 that is formed by the cylindrical heating wall 211 acts is lengthened, making it possible to increase the heat absorbing efficiency.

The embodiment shown in FIG. 11 illustrates a flow passage 210 formed by a cylindrical heating wall 211 that constitutes a pair of displacer cylinders of the displacer unit. In the embodiment shown in FIG. 11, a core member 219 is disposed in the central portion of the flow passage 210 over nearly the full length of the flow passage. The core member 219 is mounted on the inner peripheral edges of a plurality of fins 214 formed on the inner peripheral surface of the cylindrical heating wall 211. By thus disposing the core member 219 in the central portion of the flow passage 210 that contributes little to the exchange of heat, the exhaust gas as the heat source that flows through the flow passage 210 is caused to flow close to the inner peripheral surface of the heating wall 211, making it possible to improve the heat exchange efficiency. In this case, the core member 219 works as a heat accumulator and hence, the heat exchange efficiency is further improved.

In the foregoing, the invention was described based on the embodiments illustrated in the drawings. The invention, however, is not limited to these embodiments only but can be modified in a variety of ways. In the illustrated embodiments, for example, the operation chambers of the power cylinders constituting the power piston units are communicated with the contraction chambers of the displacer cylinders. However, the operation chambers may be communicated with the expansion chambers of the displacer cylinders. In the illustrated embodiments, further, the heated fluid such as the exhaust gas flows through the flow passage formed by the cylindrical heating wall that constitutes the displacer cylinders of the displacer unit. The flow passage, however, may be designed as a combustion chamber of the combustor.

Being constituted as described above, the Stirling engine according to the present invention exhibits action and effect as described below.

Namely, the displacer cylinders of the displacer unit are formed by the heating wall that surrounds the heat source and by the cooling walls that form a plurality of cylinder chambers surrounding the heating wall. Accordingly, the heat of the heat source is effectively utilized without being emanated to the surrounding. Further, the heating wall is formed in a curved shape and hence, can possess a wide heat-receiving area to efficiently absorb the heat of the heat source.

What is claimed is:

1. A Stirling engine comprising:

a displacer unit having displacer cylinders, displacers slidably arranged in the chambers of said displacer cylinders, expansion chambers and contraction chambers into which, and from which, an operation gas flows with the operation of said displacers; and a power piston unit having a power cylinder with an operation chamber that communicates with either said expansion chamber or said contraction chamber of said displacer unit, and a power piston slidably arranged in said power cylinder;

wherein said displacer cylinders of said displacer unit are equipped with a heating wall surrounding a heat source and cooling walls forming a plurality of cylinder chambers surrounding said heating wall; and said displacers of said displacer unit are slidably arranged in said plurality of cylinder chambers in the directions to approach said heat source and to separate away from said heat source.

2. A Stirling engine according to claim 1, wherein said heating wall of said displacer cylinders forms a flow passage through which said heat source flows.

3. A Stirling engine according to claim 2, wherein the flow passage formed by said heating wall is of a cylindrical shape.

4. A Stirling engine according to claim 1, wherein a plurality of fins are provided in the axial direction on the inner peripheral surface of said cylindrical heating wall constituting said displacer cylinders.

5. A Stirling engine according to claim 4, wherein said fins are formed in a spiral shape.

6. A Stirling engine according to claim 1, wherein a core member is arranged in the central portion of said flow passage formed by said cylindrical heating wall that constitutes said displacer cylinders over nearly the full length of said flow passage.

7. A Stirling engine according to claim 1, wherein:

said displacer unit comprises a pair of displacer cylinders arranged facing each other, and a pair of displacers slidably arranged in said pair of displacer cylinders;

said power piston unit comprises a power cylinder that communicates with either said expansion chamber or said contraction chamber of the pair of displacers, and a power piston that is slidably arranged in said power cylinder and divides it into a first operation chamber and a second operation chamber; and said first operation chamber of said power piston unit is communicated with either said expansion chamber or said contraction chamber of said displacer unit through a first communication passage, and said second operation chamber of said power piston unit is communicated with said other expansion chamber or said contraction chamber of said displacer unit through a second communication passage.

* * * * *